US006871463B2

(12) United States Patent
Placuzzi

(10) Patent No.: US 6,871,463 B2
(45) Date of Patent: Mar. 29, 2005

(54) MOSAIC TESSERA PARTICULARLY FOR OUTDOOR AND/OR INDOOR PAVING

(76) Inventor: Maurizio Placuzzi, Via Domenico Zotti, 14, 48100 Ravenna (IT)

( * ) Notice: Subject to any disclaimer, the term of this patent is extended or adjusted under 35 U.S.C. 154(b) by 0 days.

(21) Appl. No.: 09/852,340

(22) Filed: May 11, 2001

(65) Prior Publication Data

US 2002/0043047 A1 Apr. 18, 2002

(30) Foreign Application Priority Data

Oct. 17, 2000 (IT) ..... BO20000141 U

(51) Int. Cl.[7] ..... E04F 15/06
(52) U.S. Cl. ..... 52/390; 52/506.01
(58) Field of Search ..... 52/177, 390, 796.1, 52/403.1, 506.01; 428/465, 467, 492, 497, 308.4, 318.4, 319.1, 328, 49

(56) References Cited

U.S. PATENT DOCUMENTS 2,145,068 A * 1/1939 Batcheller ..... 52/796.1
2,270,902 A * 1/1942 Rubissow ..... 52/403.1
2,841,004 A * 7/1958 Maccaferri ..... 52/390
2,970,124 A * 1/1961 Drummond ..... 52/390

FOREIGN PATENT DOCUMENTS

FR 2 161 369 7/1973
FR 2 501 758 9/1982

* cited by examiner

*Primary Examiner*—Michael Safavi
(74) *Attorney, Agent, or Firm*—Sofer & Haroun, LLP

(57) ABSTRACT

A mosaic tessera, particularly for outdoor and/or indoor paving, constituted by a small metallic plate which is peripherally provided with perimetric raised portions forming a recess together with the corresponding face of the plate and by a filler element which is shaped complementarily to the recess and is associated with the recess so as to form a single tessera adapted to be applied to the foundation of the paving.

15 Claims, 1 Drawing Sheet

MOSAIC TESSERA PARTICULARLY FOR OUTDOOR AND/OR INDOOR PAVING

BACKGROUND OF THE INVENTION

The present invention relates to a mosaic tessera particularly for outdoor and/or indoor paving.

Metal plates which, according to the most disparate criteria, are fixed on the foundation in order to provide a metallic paving are already known in the field of outdoor and/or indoor paving or cladding. Such metal plates have a limited thickness due to high cost of steel. Containment of the thickness of the large metal plate causes sagging, which becomes apparent with the bending of the peripheral edges of large plates with respect to the plane that contains such plates. This forces the operator to intervene during and after laying in order to straighten and fix on the foundation the edges which are bent upwardly.

SUMMARY OF THE INVENTION

The aim of the present invention is to obviate the cited drawbacks by providing a paving or cladding which does not suffer the above mentioned problems.

Within this aim, an object of the present invention is to provide mosaic tesserae whose shape is useful and has a low-cost for industrial application.

Another object of the present invention is to provide a structure which is simple, relatively easy to provide in practice, safe in use and effective in operation.

This aim and these and other objects which will become better apparent hereinafter are achieved by a mosaic tessera, particularly for outdoor and/or indoor paving, characterized in that it is constituted by a small metallic plate being peripherally provided with perimetric raised portions which form a recess together with the corresponding face and by a filler element which is shaped complementarily to said recess and is associated with said recess so as to form a single tessera adapted to be applied to the foundation of the paving.

BRIEF DESCRIPTION OF THE DRAWINGS

Further characteristics and advantages will become better apparent from the following detailed description of a preferred but not exclusive embodiment of a mosaic tessera, according to the invention, illustrated only by way of non-limitative example in the accompanying drawings, wherein.

DESCRIPTION OF THE PREFERRED EMBODIMENTS

Figure 2:
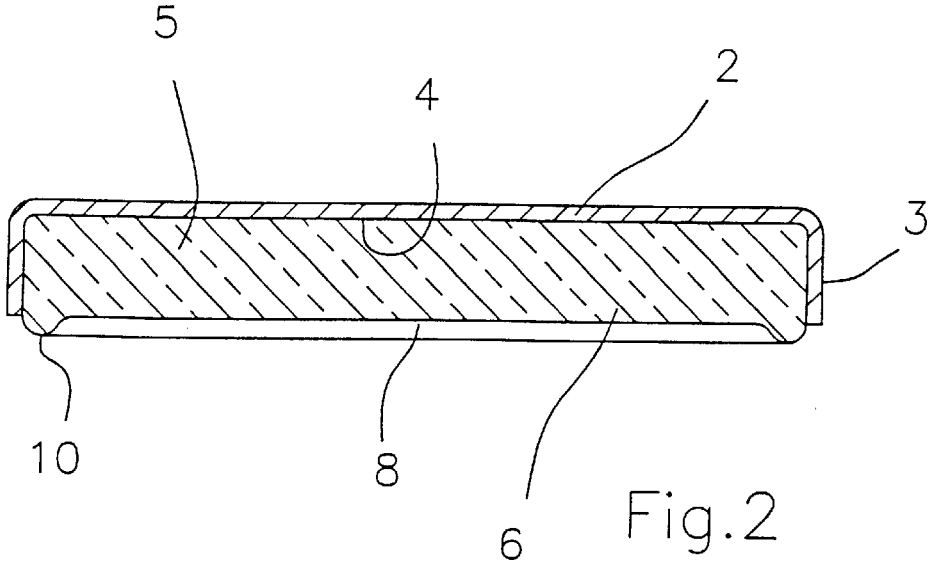
FIG. 2 is a sectional view, taken along a transverse axial plane, of the tessera.
Figure 1:
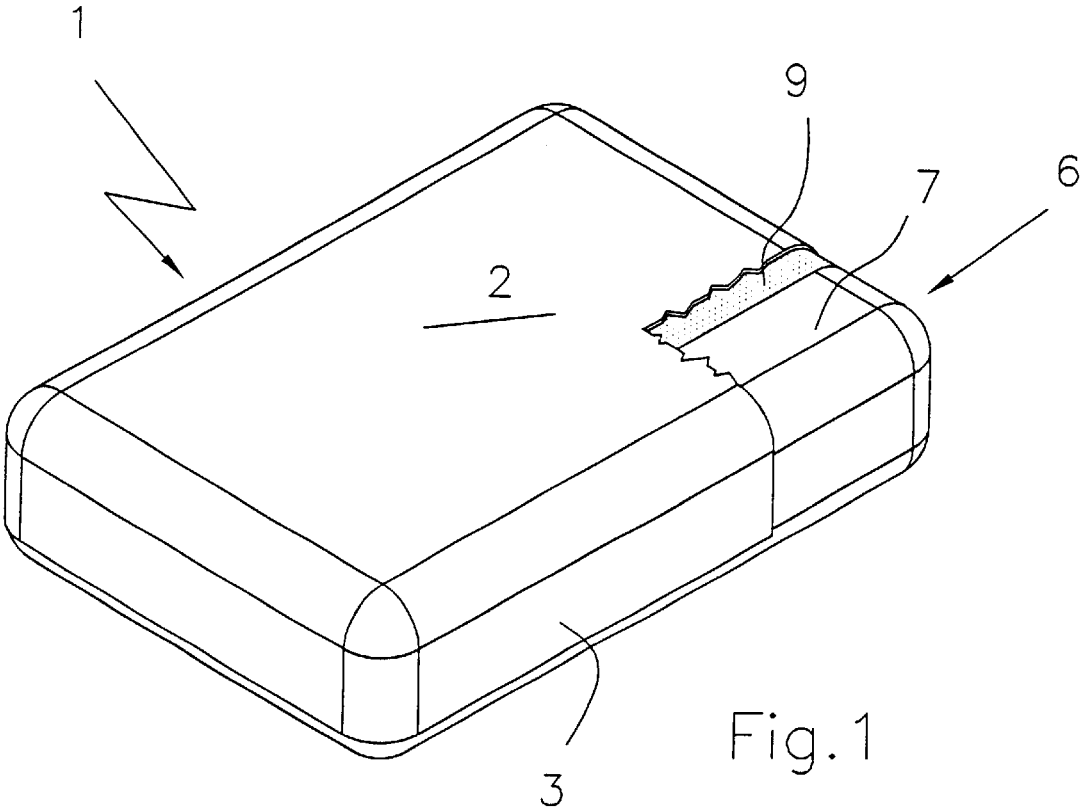
FIG. 1 is a perspective view of the tessera according to the invention, illustrating the filler element.

With reference to the figures, the numeral 1 generally designates a mosaic tessera according to the invention. The tessera 1 is constituted by a small rectangular metallic plate 2 peripherally provided with perimetric raised portions 3 which form a recess 5 together with the corresponding face 4. Conveniently, the raised portions 3 give greater rigidity to the small metal plate 2. A filler element 6 is complementarily associated with the recess 5 and has an elasticity selected according to the application requirements, which can vary according to the type of material that composes the filler element 6; in particular, elasticity decreases from a high to a low value, when changing from rubber-like or gummy materials to electrically conducting pastes.

The filler element has an internal surface 7 and an external surface 8 between which it is possible to interpose a film of adhesive 9 in order to facilitate the intimate bonding of the filler element 6 in the recess 5 and thus form, together with the small plate 2, the single tessera 1. The outer surface 8 forms peripherally perimetric rims 10 which produce a sort of sucker which is useful during the application step of the tessera 1 to the foundation of the floor.

Conveniently, the filler element 6, made of rubber-like or gummy material or electrically conducting paste, acts, when the tessera is applied to the floor, as a dent-preventing pad in response to the external stresses induced by treading which affect each tessera 1 in practical use.

In use, after composing the individual tessera 1 as described above, the tesserae are applied and glued to the foundation to as to form a metal floor.

It has thus been shown that the invention achieves the intended aim and objects.

In particular, it should be noted that each tessera can be obtained by blanking/punching a low-thickness steel lamina, thus having a considerable effect on the industrial cost-effectiveness of laying metal paving. In this manner it is possible to provide a metallic flooring in which the thickness of the plates is considerably lower than the thickness of large metal plates.

Finally, it is noted that the tesserae thus obtained are extremely light in weight and easy to transport and store.

The invention thus conceived is susceptible of numerous modifications and variations, all of which are within the scope of the appended claims.

In particular, tesserae having geometric shapes other than the one illustrated also fall within the scope of the present invention.

The details may further be replaced with other technically equivalent ones.

Finally, the dimensions may be any according to requirements without thereby abandoning the scope of the protection of the appended claims.

The disclosures in Italian Utility Model Application No. BO2000U000141 from which this application claims priority are incorporated herein by reference.

What is claimed is:

1. A mosaic tessera, for outdoor and/or indoor paving, characterized in that it comprises a small metallic plate, which is peripherally provided with perimetric raised portions forming a recess together with an internal corresponding face of the plate; and a filler element, shaped complementarily to said recess, and maintained within said recess, wherein said filler element comprises peripherally perimetric rims forming an open cavity in the center of said mosaic tessera below an outer surface of said filler element, and where said peripherally perimetric rims of said filler element extend below said perimetric raised portions of said tessera such that when pressure is applied to said metallic plate said peripherally perimetric rims of said filler element compress, forming a suction between said tessera and the surface to which it is being applied.

2. The tessera of claim 1, characterized in that said filler element is substantially elastic.

3. The tessera according to claim 2, characterized in that said filler element is made of any rubber-like and gummy material.

4. The tessera according to claim 2, characterized in that said filler element constitutes a substantially electrically conducting paste.

5. The tessera according to claim 1, further characterized in that it comprises a film of adhesive arranged between a surface region of said filler element and said internal plate face, to facilitate intimate bonding of said filler element in said recess.

6. The tessera according to claim 1, characterized in that said filler element acts as a pad for preventing dents in response to external treading stresses.

7. A mosaic tessera for use on a bonding surface, comprising:

a metallic plate having a top surface and a bottom side; said plate having peripherally perimetric raised portions which form a recess; and an elastic filler element having a body region and a rim region, said filler element disposed within said recess and in adhesive contact with said bottom side of said metallic plate, said filler element having a lower surface, said lower surface of said filler element forming a peripherally perimetric rim region so that said body region of said filler element and said metallic plate are raised relative to the bonding surface, said peripherally perimetric rim forming a suction between the tessera and said bonding surface when pressure is applied to the top surface of said metallic plate.

8. The tessera of claim 7, wherein said filler element is substantially elastic.

9. The tessera according to claim 7, wherein said filler element is made of any one of a rubber-like material and a gummy material.

10. The tessera according to claim 7, wherein said filler element constitutes a substantially electrically conducting paste.

11. The tessera according to claim 7, further comprises a film of adhesive layer arranged between said bottom side of said metallic plate and said filler element face, to facilitate intimate bonding of said filler element in said recess.

12. The tessera according to claim 7, wherein said filler element acts as a pad for preventing dents in response to external treading stresses.

13. The tessera according to claim 7, wherein said metallic plate is tray shaped.

14. The tessera according to claim 7, wherein said peripherally perimetric raised portions of said metallic plate extend around the entire tessera.

15. The tessera according to claim 14, wherein said peripherally perimetric rim of said filler element extends around the entire tessera inside of said peripherally perimetric raised portions.

* * * * *